US009474307B2

(12) United States Patent
Cartozian

(10) Patent No.: US 9,474,307 B2
(45) Date of Patent: Oct. 25, 2016

(54) PANTS TO ASSIST IN HOLDING UP A DIAPER

(71) Applicant: Stephanie Cartozian, Palos Verdes Estates, CA (US)

(72) Inventor: Stephanie Cartozian, Palos Verdes Estates, CA (US)

( * ) Notice: Subject to any disclaimer, the term of this patent is extended or adjusted under 35 U.S.C. 154(b) by 21 days.

(21) Appl. No.: 14/724,697

(22) Filed: May 28, 2015

(65) Prior Publication Data

US 2016/0050980 A1 Feb. 25, 2016

Related U.S. Application Data

(63) Continuation-in-part of application No. 14/468,101, filed on Aug. 25, 2014, now abandoned.

(51) Int. Cl.

| | |
|---|---|
| ***A41B 3/04*** | (2006.01) |
| ***A41B 1/06*** | (2006.01) |
| ***A41B 13/00*** | (2006.01) |
| ***A41B 13/04*** | (2006.01) |
| *A41B 11/14* | (2006.01) |
| *A41D 15/00* | (2006.01) |

(52) U.S. Cl.

CPC ..... *A41B 13/04* (2013.01); *A41B 1/06* (2013.01); *A41B 13/005* (2013.01); *A41D 15/00* (2013.01)

(58) Field of Classification Search

CPC .. A41B 13/005; A41B 11/002; A41D 11/00; A41D 10/00; A41D 15/002; A41D 13/129; A41F 19/00; A41F 5/00; A43B 7/08; A43B 7/125

See application file for complete search history.

(56) References Cited

U.S. PATENT DOCUMENTS

| | | | | | |
|---|---|---|---|---|---|
| 2,455,852 | A * | 12/1948 | Campbell | A41F 19/00 | 2/323 |
| 2,528,677 | A * | 11/1950 | Wilson | A41B 13/005 | 2/83 |
| 2,563,161 | A * | 8/1951 | Dixon | A41B 13/005 | 2/80 |
| 2,588,542 | A * | 3/1952 | Kunz | A41B 13/005 | 2/80 |
| 3,329,972 | A * | 7/1967 | Schwab | A41D 11/00 | 2/239 |
| 4,894,867 | A | 1/1990 | Ceravolo et al. | | |
| 4,961,233 | A | 10/1990 | Black | | |
| 5,553,399 | A * | 9/1996 | Strong | A43B 3/16 | 36/44 |
| 5,738,937 | A * | 4/1998 | Baychar | A43B 5/0405 | 36/3 R |
| 6,026,516 | A * | 2/2000 | Dacyshyn | A41D 1/082 | 2/227 |
| 6,088,831 | A * | 7/2000 | Jensen | F41H 1/02 | 2/117 |
| 6,389,600 | B1 * | 5/2002 | Di Maio | A41D 13/0015 | 2/115 |

(Continued)

*Primary Examiner* — Bobby Muromoto, Jr.
(74) *Attorney, Agent, or Firm* — Trojan Law Offices

(57) ABSTRACT

A system and method for holding up diaper in infant pants. The system generally includes pants, shirt, and at least two straps that secure the top side of the pants and the bottom side of the shirt either on the front, back, interior, or exterior sides of the pants and shirt. Those straps may also be adjustable for tautness. A further embodiment includes foot coverings that extend from the pants to cover the infant's feet. Such foot coverings may be made from a breathable material. The invention may also include cushioning to protect the infant from falls. Finally, the invention generally includes elastic bands and cushioning on the buttocks portion of the pants to prevent an infant's diaper from sagging downward.

19 Claims, 11 Drawing Sheets

(56) References Cited

U.S. PATENT DOCUMENTS 6,981,341 B2 * 1/2006 Baychar ..... A43B 3/0084 36/115
7,081,036 B1 7/2006 Howard et al.
7,213,420 B2 * 5/2007 Lynch ..... A41B 11/005 66/186
8,356,365 B2 * 1/2013 Wolfson ..... A41D 10/00 2/111
2003/0089136 A1 * 5/2003 Lynch ..... A41B 11/005 66/187
2006/0206991 A1 * 9/2006 Barnes ..... A41F 19/00 2/311
2007/0227038 A1 * 10/2007 Edington ..... A43B 19/00 36/10
2009/0235433 A1 * 9/2009 Harris ..... A43B 17/107 2/239
2011/0030117 A1 * 2/2011 Wolfson ..... A41D 10/00 2/80
2011/0197335 A1 * 8/2011 Handy ..... A41F 5/00 2/117
2012/0167276 A1 * 7/2012 Brosie ..... D06F 95/008 2/239
2012/0255201 A1 * 10/2012 Little ..... A43B 1/04 36/84
2014/0298559 A1 * 10/2014 Gongora Montes . A41B 13/005 2/52
2014/0325732 A1 * 11/2014 Anderson ..... A63B 21/00185 2/69
2015/0181978 A1 * 7/2015 Piontkowski ..... A43B 7/1425 36/44

* cited by examiner

PANTS TO ASSIST IN HOLDING UP A DIAPER

CROSS-REFERENCE TO RELATED APPLICATIONS

This application is a continuation-in-part of Ser. No. 14/68,101, filed on Aug. 25, 2014.

FIELD OF THE DISCLOSURE

The present invention relates to field of clothing and more particularly concerns infant sleepwear that minimizes the risk of infant smothering, suffocation, and strangulation and helps to hold up an infant's diaper.

BACKGROUND

Smothering is an unfortunate cause of death of newborns and infants in the United States. Some causes of infant smothering include infant overlay and positional asphyxia. Infant overlay occurs when an infant is sleeping with an adult and the adult smothers the infant. Positional asphyxia occurs when an infant's face is trapped in soft bedding or is wedged in small spaces with cushions or mattresses. Often times, parents of infants are concerned about suffocation and Sudden Infant Death Syndrome (SIDS). Even though parents have utilized infant safety educational courses and utilized safety equipment on furniture in their homes to reduce the risk of infant smothering and injury, infant smothering remains a persistent concern of parents for their infant's well being. Furthermore, safety equipment on furniture and safety courses may not offer meaningful solutions to address the risks of infant suffocation due to the infant's own clothing.

Different types of infant sleepwear offer parents benefits and detriments when dressing their infants for bed. Parents may be concerned about whether to dress their infant in a one-piece or two-piece garment when the infant sleeps. Garments made as one piece covering the infant's entire body or two-piece garments (i.e. pants and shirt) are a safety issue for parents concerned about infant suffocation. Dressing infants in a one-piece garment may be inconvenient for parents since the one-piece garments are more difficult to remove and there is less variety in dressing the infant. On the other hand, dressing infants in two-piece garments may offer parents more variety when dressing their infant, but bears the risk of a separate shirt riding up and interfering with the infant's breathing. Both types of clothing have benefits and detriments more particularly described below.

Infants may wear one-piece pajama garments where the shirt and pants are comprised of one continuous garment. However, one-piece garments may cover an infant's entire body. For example, an "onesie" covers the arms, legs, and torso of an infant. Alternatively, one-piece garments may leave parts of the infant's legs exposed to allow the parents to easily access the infant's diaper or to change the infant. One-piece garments are often cumbersome for parents to remove or to dress the infant. Additionally, one-piece garments may not regulate an infant's temperature properly. If the garment covers the infant's entire body, the infant may be very warm. Some one piece garments expose the infant's legs so the infant may get cold. To address the issue of temperature regulation of the infant, a parent may dress an infant in a two-piece garment with separated pants and a shirt. However, the risk of suffocation or strangulation for an infant dressed in a two-piece garment is a concern to parents. Thus, there is a need for two-piece sleepwear for infants that address these risks.

Furthermore, an infant's diaper may drag down a pair of pants due its size. Moreover a diaper may become saturated when an infant is sleeping or between diaper changes. When an infant's diaper is full, the weight and increased size of the diaper might cause an infant's pants to be dragged down, causing the infant discomfort.

With the foregoing in mind, a system of infant clothing is required that has the convenience of dressing an infant in a two-piece outfit, but without the concerns of infant suffocation. With the need for that system in mind, the inventor has created a two-piece anti-smother baby sleepwear system that minimizes the risk of infant suffocation and also helps to hold up an infant's diaper.

SUMMARY

In accordance with the invention, the infant suffocation problem is eliminated by securing the infant shirt to the infant pants thereby preventing the infant shirt from riding up and interfering with the infant's ability to breath. A system where the infant pajama top is secured to the infant sleepwear bottom allows infants to wear two-piece sleepwear, but reduces the risk of smothering, suffocation, or strangulation from the infant pajama top. The invention also holds up an infant's diaper using at least one elastic band in the infant's pants.

The system includes a pair of pants and a shirt. The pants and the shirt are connected by at least two straps that connect the front side, the back side, or both sides of the shirt to the pants. The straps connect the top portion of the pants to the bottom portion of the shirt in a spaced apart relationship from each other. One end of each strap connects to the bottom portion shirt and one end of each strap connects to the top portion of the pants. The straps may fasten to the shirt and the pants on the interior, exterior, or any combination thereof.

The system may also include at least one elastic band starting at the right side of the bottom of the buttocks portion of the pants to the left side of bottom of the buttocks portion of the pants. Such elastic band would prevent the infant's diaper from sagging and dragging down the pants, especially if the diaper is full.

The elastic band would also support the diaper and prevent a diaper from putting too much weight on the straps connecting the pants to the shirt and causing the infant discomfort from the shirt exerting pressure on the infant's body. Furthermore, with the at least one elastic band securing the diaper closer to the infant's body, there will be less likelihood of leakage from a diaper, especially a diaper that is full. If the elastic bands are used in conjunction with padding located on the buttocks of the pants, then the diaper will also be better secured to the infants body through the extra cushioning and the force from the at least one elastic band.

The system can also include extended foot coverings that are continuous from the pants. Such foot coverings may be made from a breathable material that readily exchanges air and moisture from the outside of the foot coverings to the inside of the foot coverings. The breathable nature of the material will allow an infant's feet to stay cool during the hotter seasons of the year by promoting air and moisture exchange.

The system can also include cushioning on the pants. The cushioning may be placed back side, front side, or both sides of the pants to prevent injuries to the infant if the infant should fall. Another embodiment of the invention can be comprised of pants that are slightly longer than knee length and forego the foot coverings for a more active lifestyle.

The system may also include straps that have a plurality of fasteners to adjust the tautness of the straps to fit the size of the infant.

Furthermore, the invention may consist of elastic bands located on the buttocks portion of the pants to support an infant's diaper and prevent the diaper from dragging down the infant's pants.

The invention also consists of a method to prevent infant suffocation from the infant's clothing that may cover the infant's face. The method comprises the following steps: providing the infant with a shirt and pants. Next, the parent can connect the pants and shirt with at least two straps that connect on the front side, the back side, or both sides of the shirt to the pants. One end of each strap connects to the bottom portion of shirt and one end of each strap connects to the top portion of the pants. The parent may connect the shirt and the pants by fastening the straps on the interior, exterior, or any combination thereof. Thus, a parent may dress their infant in a manner that is suitable for the weather, in a manner that is convenient for changing the infant's clothes and diaper, and also reducing the risk of infant suffocation where an infant's shirt may cover the infant's face.

DETAILED DESCRIPTION OF EMBODIMENTS

Figure 2:
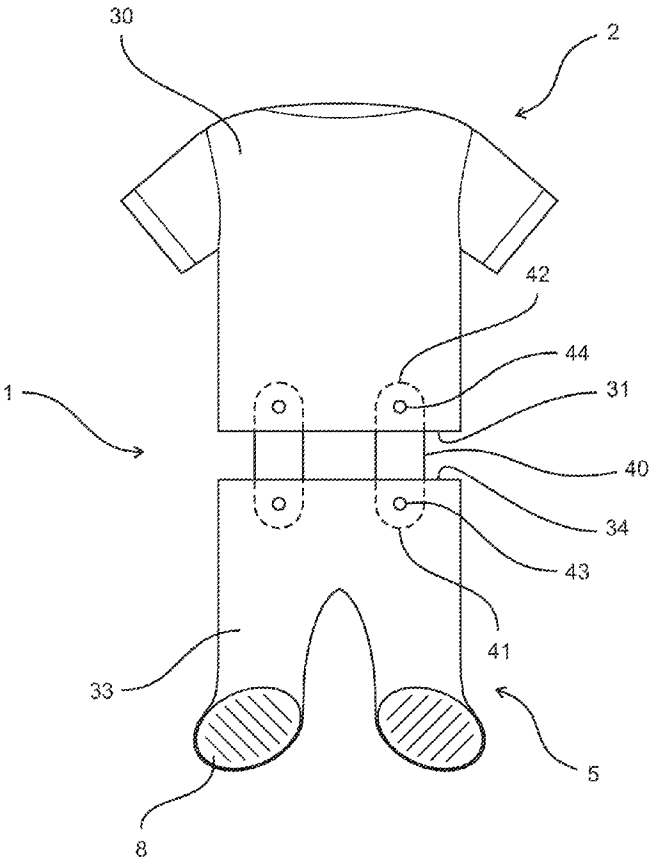
FIG. 2 is a rear view of the embodiment shown in FIG. 1.

The detailed description set forth below in connection with the appended drawings is intended to provide example embodiments of the present invention and is not intended to represent the only forms in which the invention may be constructed or utilized. The description sets forth the function and the sequences of steps for constructing and operating the invention. However, it is to be understood that the same or equivalent functions and sequences may be accomplished by different embodiments that are also intended to be encompassed within the spirit and the scope of the invention.

Some embodiments of the invention will be described in detail with reference to FIGS. 1-16. Additional embodiments, features, and/or advantages of the invention will become apparent from the description or may be learned by practicing the invention. The drawings in the figures are not to scale and have like numerals referring to like features through both the drawings and the description.

FIGS. 1, 3, 5, and 7 illustrates the front view of a system of diaper supporting clothing 1 for an infant. The clothing 1 may be made from a soft-fabric material such as cotton, polyester, cotton-polyester blend, or an equivalent material appropriate for sleepwear. Furthermore, the clothing 1 can be comprised of a pair of pants 5 having a front side 6 an exterior side 13, an interior side 12, and a top edge 7. The system may also be comprised of a shirt 2 having a front side 3, an exterior side 11, an interior side 10, and a bottom edge 4. The system further comprises, at least two straps 20, each having a first end 21 and a second end 22 wherein the first end 21 of each strap may be secured to the pair of pants 5 in proximity to the top edge 7 of the pants 5 in spaced apart relationship to each other. The second end 22 of each strap is secured to the shirt 2 in proximity to the bottom edge 4 of the shirt 2.

Figure 1:
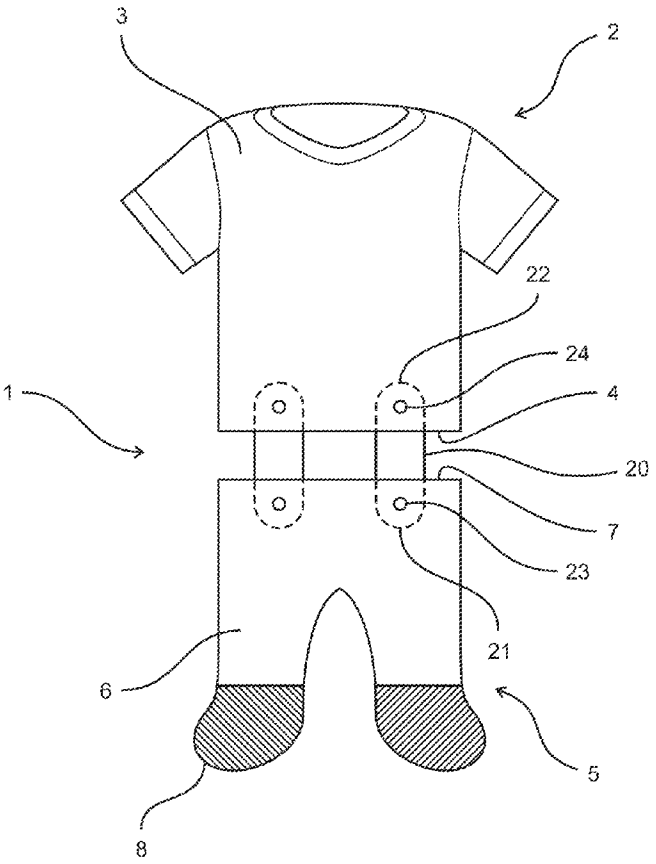
FIG. 1 is a front view of an embodiment of a system in accordance with the present invention with foot coverings extending from the pants where the foot coverings are made of a breathable material.
Figure 4:
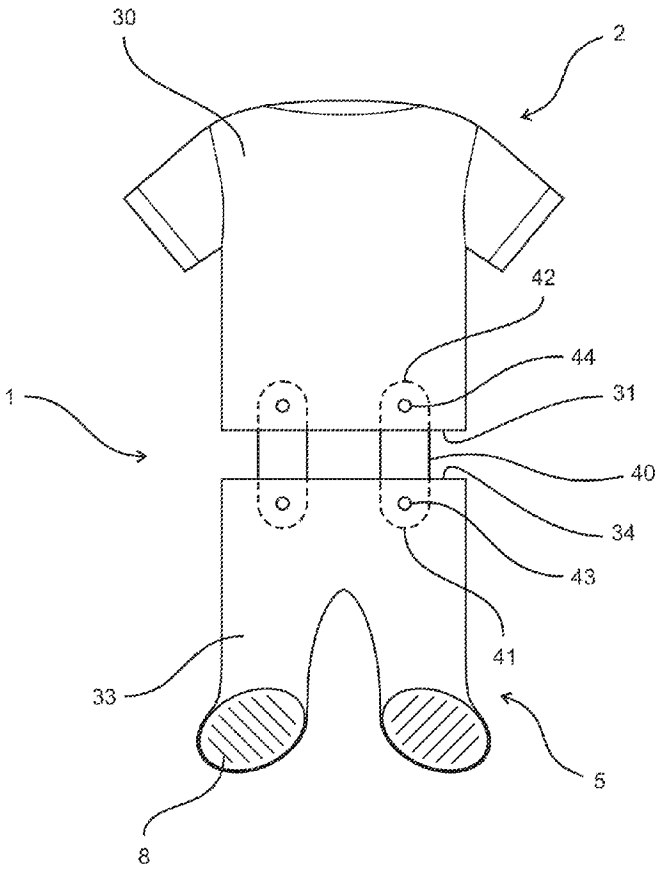
FIG. 4 is the rear view of an embodiment shown in FIG. 3.
Figure 3:
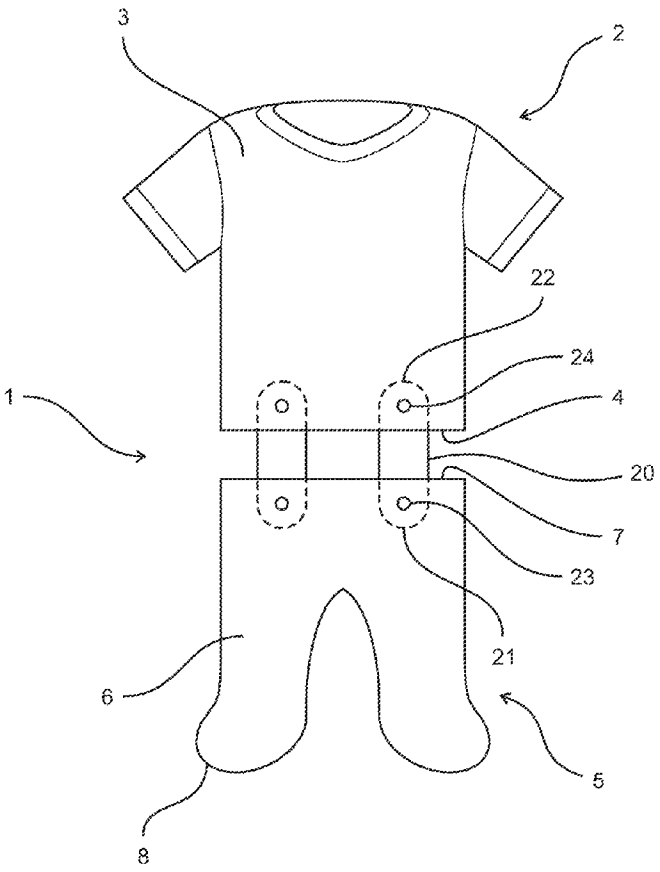
FIG. 3 is front view of an embodiment of a system in accordance with the present invention with foot coverings that are continuous from the pants.

The at least two straps 20 are secured to the pants and shirt by means of fasteners 23 and 24. The straps 20 may be made from the same material as the clothing 1 or a different blend of material for greater rigidity or softness of the straps. Near the first end 21 of the strap 20 is a fastener 23 which may be secured to the interior 12 of the pants 5 as illustrated in FIG. 1. Near the second end 22 of the strap 20 is a fastener 24 which may be secured to the interior 10 of the shirt 2.

Figure 9:
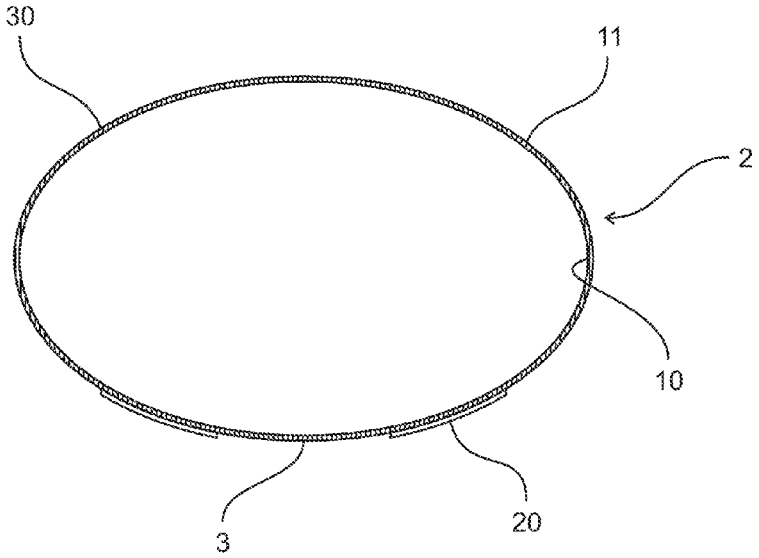
FIG. 9 is an axial view of an embodiment with straps fastened to the front, exterior of the shirt.
Figure 10:
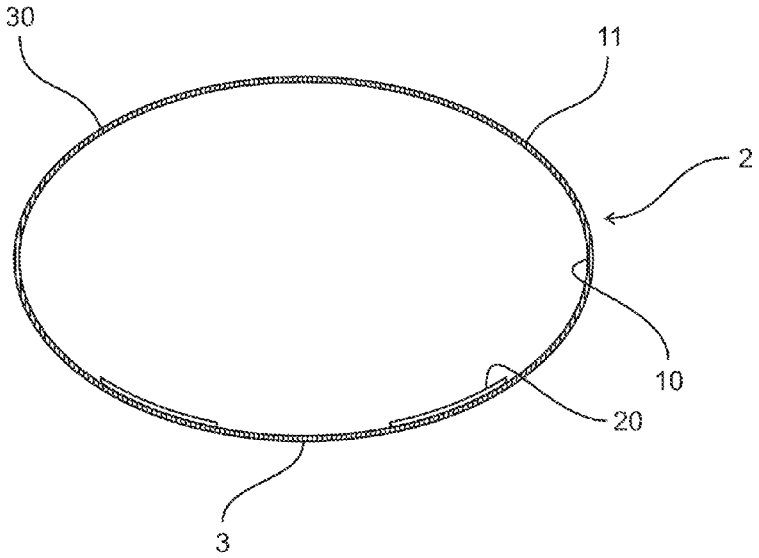
FIG. 10 is an axial view of an embodiment with straps fastened to the front, interior of the shirt.
Figure 11:
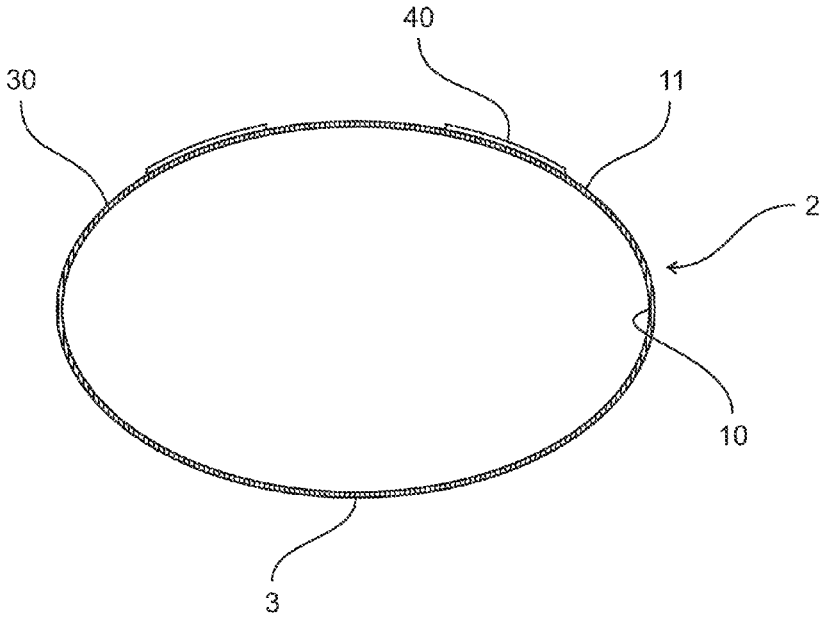
FIG. 11 is an axial view of an embodiment with straps fastened to the back, exterior of the shirt.
Figure 13:
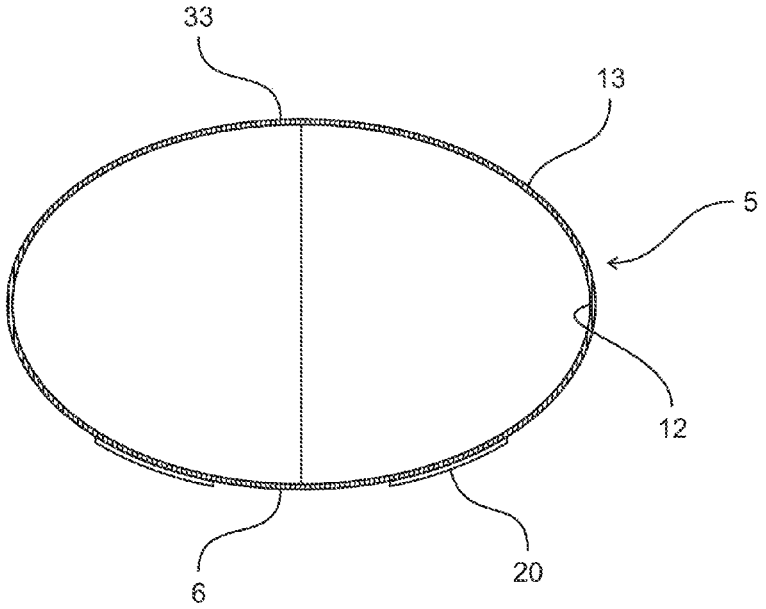
FIG. 13 is an axial view of an embodiment with straps fastened to the front, exterior of the pants.
Figure 14:
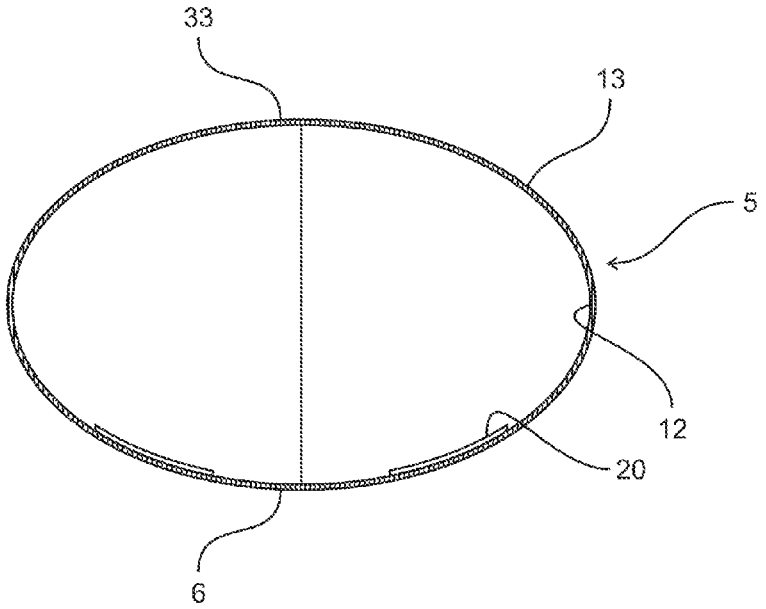
FIG. 14 is an axial view of an embodiment with straps fastened to the front, interior of the pants.

To illustrate the positioning of the clothing 1 and the strap 20, FIG. 9 shows the an axial view of the above embodiment with strap 20 fastened to the front 3 of the shirt 2 on the exterior 11 side. FIG. 10 shows the an axial view of the above embodiment with strap 20 fastened to the front 3 of the shirt 2 on the interior 10 side. FIG. 13 shows the an axial view of the above embodiment with strap 20 fastened to the front 6 of the pants 5 on the exterior 13 side. FIG. 11 shows the an axial view of the above embodiment with strap 20 fastened to the front 6 of the pants 5 on the interior 12 side.

As illustrated in the figures above, one who practices the invention may also secure the strap 20 as described above to the exterior 13 of the pants 5, the exterior 11 of the shirt 2, or any combination thereof. Securing the strap 20 to the interior 10 of the shirt 2 (or the interior 12 of the pants 5) may prevent the infant from undoing the straps. Securing the straps 20 to the exterior 11 of the shirt 2 (of the exterior 13 pants 5) may be more convenient for the parent who wishes to change the infant's clothing or diaper with easier access to the strap 20.

When the shirt 2 and pants 5 are secured through the use of the straps 20, the shirt 2 is resistant to riding up to smother the baby's face. Thus, babies are able to wear clothing 1 with less risk of suffocation, better temperature regulation, and offer parents greater ease in changing their infants.

FIGS. 2, 4, 6, 8, 17, 18, and 19 illustrate the rear view of a system of diaper supporting clothing 1 for an infant that can be comprised of a pair of pants 5 having a back side 33, an exterior side 13, an interior side 12, and a top edge 34. The system can also comprise of a shirt 2 having a back side 30, an exterior side 11, an interior side 10 and a bottom edge 31. The system may be further comprised of at least two straps 40, each having a first end 41 and a second end 42. The first end 41 of each strap 40 may be secured to the pair of pants 5 in proximity to the top edge 34 of the pants 5 in spaced apart relationship to each other with fastener 43. The second end 43 of each strap 40 may be secured to the shirt 2 in proximity to the bottom edge 31 of the shirt 2 with fastener 44.

Figure 18:
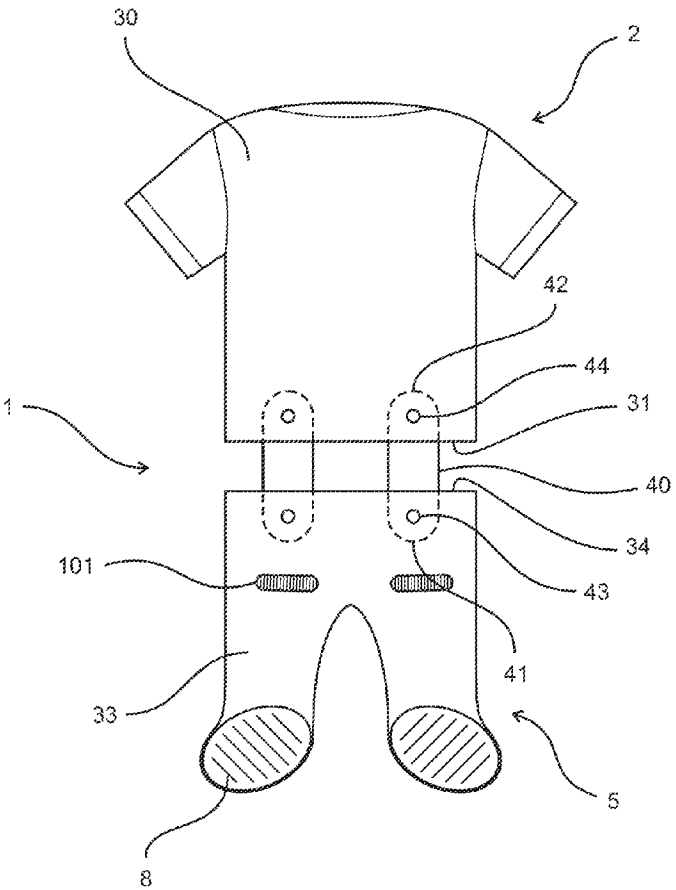
FIG. 18 is the rear view of an embodiment shown in FIG. 3 with additional elastic straps on the right and left sides of the bottom of the buttocks portion in proximity to the end of an infant wearer's diaper underneath the pants.
Figure 17:
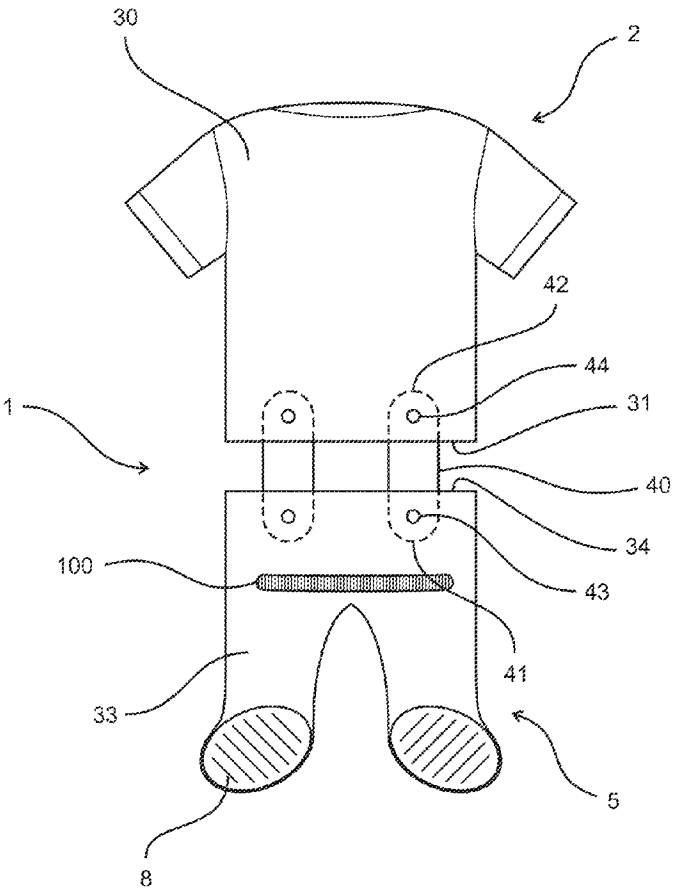
FIG. 17 is the rear view of an embodiment shown in FIG. 3 with a single elastic strap that starts on the right side of the bottom of the buttocks portion of the pants and ends on the left side of the bottom of the buttocks portion of the pants.
Figure 19:
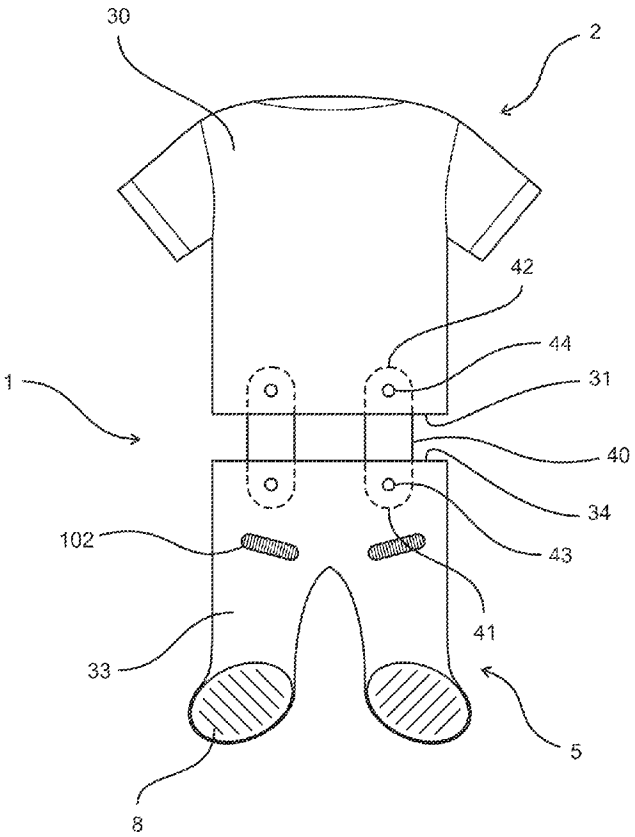
FIG. 19 is the rear view of an embodiment shown in FIG. 3 with additional elastic straps on the right and left sides of the bottom of the buttocks portion of the pants positioned at an angle that follows the line of the end of an infant wearer's diaper underneath the pants.

Additionally, in FIG. 17, the system may also include at least one elastic band 100 starting at the right side of the bottom of the buttocks portion of the pants 5 to the left side of bottom of the buttocks portion of the pants 5. The at least one elastic band 100 would prevent the infant's diaper from sagging and dragging down the pants 5, especially if the diaper is full. FIG. 18 shows the invention where at least two elastic strips 101, which can be approximately 1.5 inches in length, are placed on the bottom of the right and left sides of the buttocks portion of the pants 5. FIG. 19 shows the invention where at least two elastic strips 102, which can be approximately 1.5 inches in length, are placed on the bottom of the right and left sides of the buttocks portion of the pants 5 and are angled upwards, following the line of the end of the infant wearer's diaper. The angle of the elastic strips 102 will help to prevent the bottom of the diaper from sagging by providing support to the end of the diaper, including, but not limited to situations when the infant is upright.

The at least one elastic band 100, or bands 101, would also support the diaper and prevent a diaper from putting too much weight on the straps 20, 40 connecting the pants 5 to the shirt 2 and causing the infant discomfort from the shirt 2 exerting pressure on the infant's body. Furthermore, with the at least one elastic band 100, or bands 101, securing the diaper closer to the infant's body, there will be less likelihood of leakage from a diaper, especially from a diaper that is full.

Figure 12:
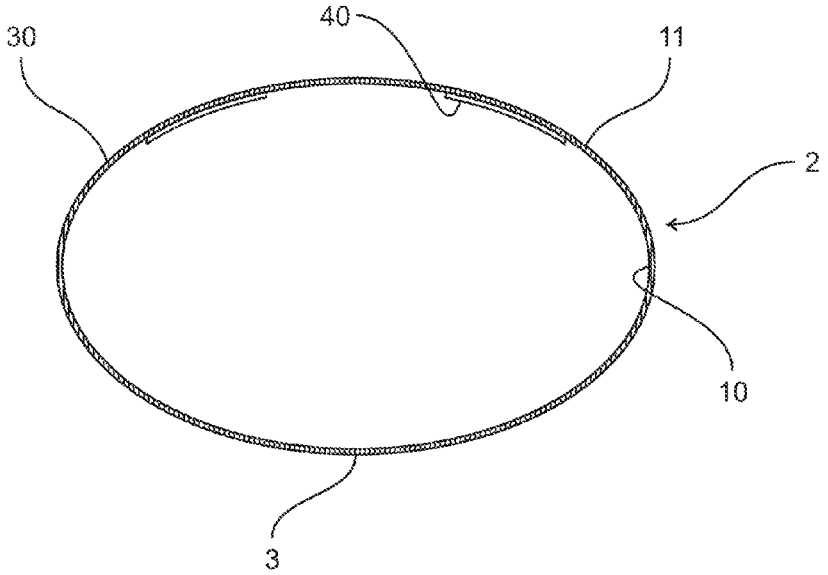
FIG. 12 is an axial view of an embodiment with straps fastened to the back, interior of the shirt.
Figure 15:
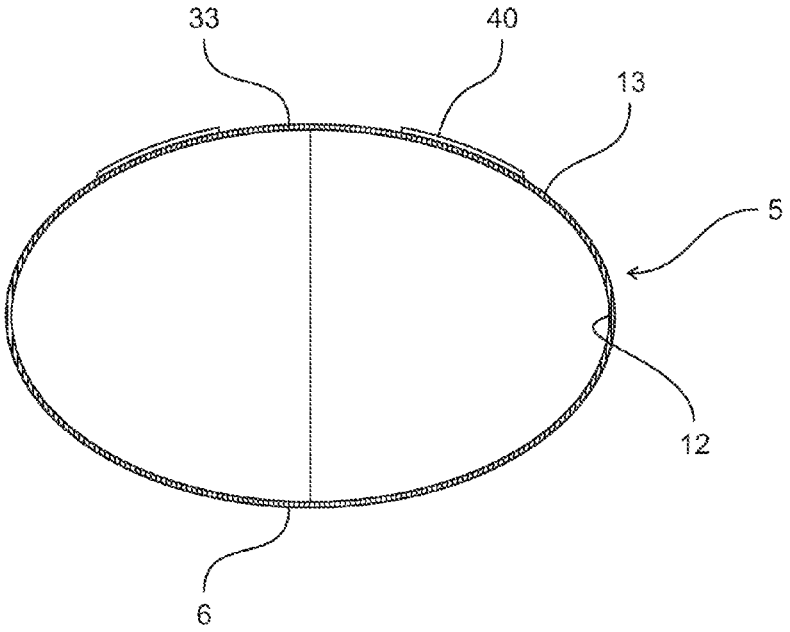
FIG. 15 is an axial view of an embodiment with straps fastened to the back, exterior of the pants
Figure 16:
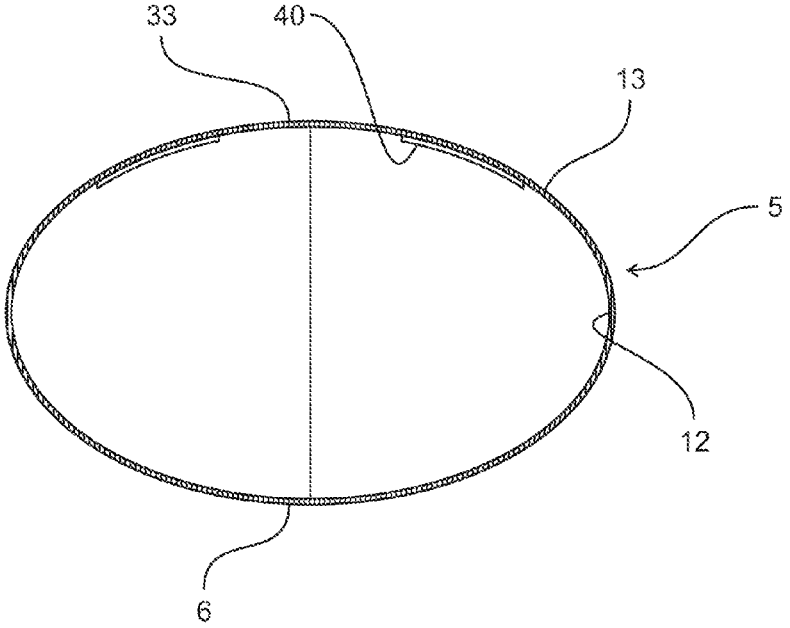
FIG. 16 is an axial view of an embodiment with straps fastened to the back, interior of the pants.

To illustrate the positioning of the clothing 1 and the strap 40, FIG. 11 shows the an axial view of the above embodiment with strap 20 fastened to the back 30 of the shirt 2 on the exterior 11 side. FIG. 12 shows the an axial view of the above embodiment with strap 40 fastened to the back 30 of the shirt 2 on the interior 10 side. FIG. 15 shows the an axial view of the above embodiment with strap 40 fastened to the back 33 of the pants 5 on the exterior 13 side. FIG. 16 shows the an axial view of the above embodiment with strap 40 fastened to the back 33 of the pants 5 on the interior 12 side.

As illustrated in the figures above, one who practices the invention may secure the strap 40 as described above to the exterior 13 of the pants 5, the exterior 11 of the shirt 2, or any combination thereof.

Also shown in FIGS. 1, 2, 3, 4, 7 and 8, the system may be comprised of a pair of foot coverings 8 that are continuous from the pants 5. Those foot coverings 8 may be made from a breathable material that readily exchanges air and moisture from the interior 12 of the pants 5 to the exterior 13 of the pants 5. As shown by FIG. 1, the foot coverings 8 may be comprised of a net-like fabric material, such as mesh or an equivalent material. The advantage of using a breathable material is to aid in temperature regulation for the infant, who may get warm wearing foot coverings 8 in the hotter seasons. FIGS. 3, 4, 7 and 8 also illustrate foot coverings 8, but those foot coverings may be comprised of the same material of the pants 5 when the advantage of breathable material is not required, such as in the colder seasons.

Figure 6:
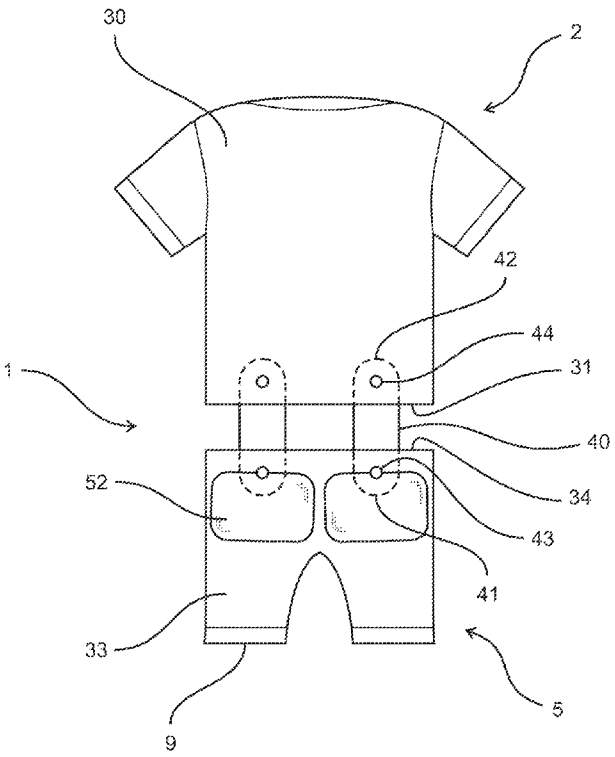
FIG. 6 is the rear view of the embodiment shown in FIG. 5 depicting the invention with cushioning on the back side of the pants.
Figure 5:
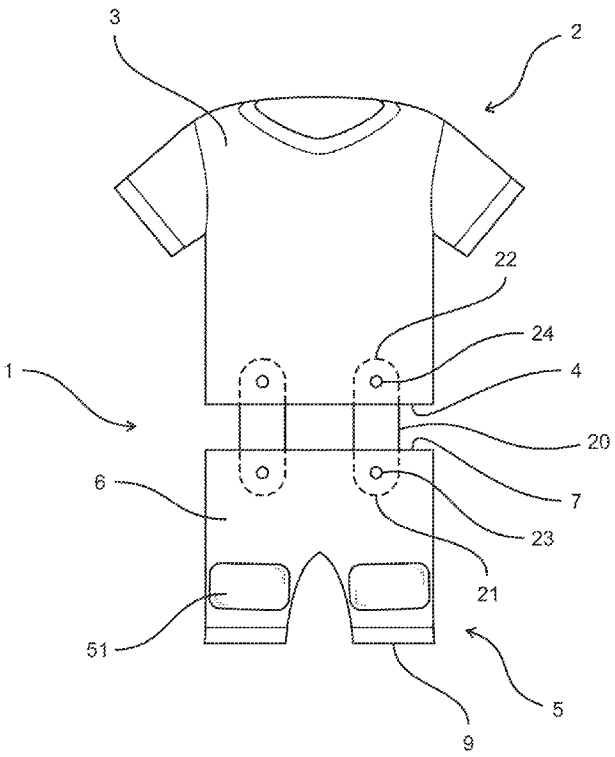
FIG. 5 is front view of an embodiment of a system in accordance with the present invention with pants with cushioning on the front side of the pants

Furthermore, FIG. 5 and FIG. 6 also show an embodiment of the system where there are no foot coverings 8 and the pants 5 are cropped 9 in length. The pants 5 that are cropped 9 in length may extend to any length over the infant's knee. Such cropped 9 length of the pants 5 may allow the infant ease of movement when participating in physical activities.

FIG. 5 and FIG. 6 further illustrates cushioning 51 and 52, which may be made from a soft fabric filler material such as polyester fiber or an equivalent material. On FIG. 5, cushioning 51 serves to protect the infant from injury in areas where an infant is prone to fall. The embodiment of FIG. 5 illustrates cushioning 51 on the front side 6 side of the pants 5 near the infant's knees when an infant may fall while learning to walk. The cushioning 51 could be placed anywhere on the front side 6 of the pants 5 where an infant is prone to falling.

Additionally, FIG. 6 illustrates cushioning 52 on the back side 33 of the pants 5 near the infant's buttocks when an infant may also fall while learning to walk. The cushioning 52 could be placed anywhere on the back side 33 of the pants 5 where an infant is prone to falling.

One who practices the invention may also provide cushioning 51 and 52 on exterior 13 of the pants 5, interior 12 of the pants 5, any position on the pants 5 where an infant may likely fall on, or any combination thereof.

Figure 20:
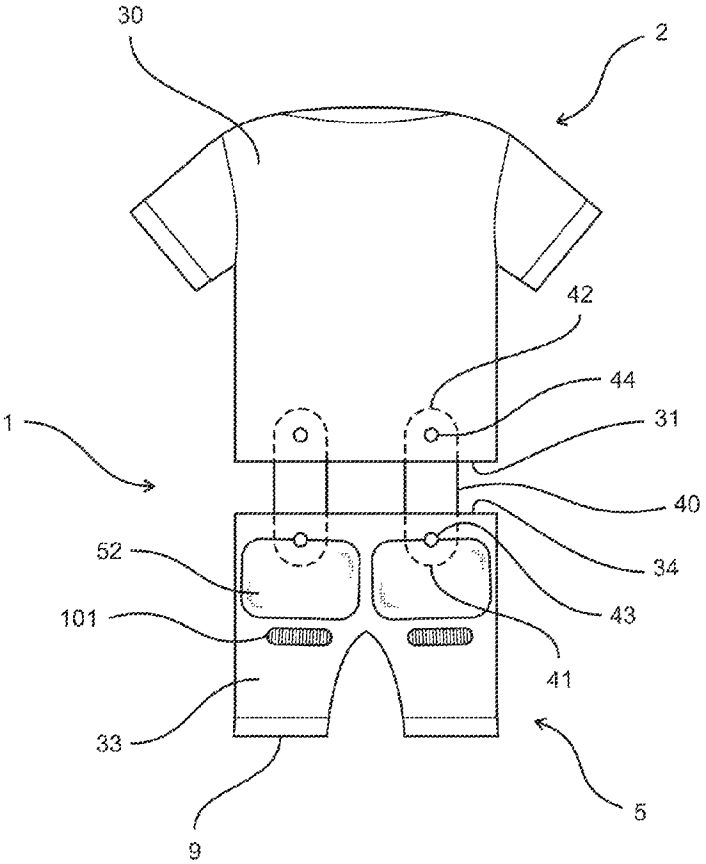
FIG. 20 is the rear view of the embodiment shown in FIG. 5 depicting the invention with cushioning on the back side of the pants and additional elastic straps on the right and left sides of the bottom of the buttocks portion of the pants.

Next, in FIG. 20, the system describes in FIGS. 5 and 6 may also include at least one elastic band 100 starting at the right side of the bottom of the buttocks portion of the pants 5 to the left side of bottom of the buttocks portion of the pants 5, such as in FIG. 17. The at least one elastic band 100 would prevent the infant's diaper from sagging and dragging down the pants 5, especially if the diaper is full. FIG. 20 shows the invention where at least two elastic strips 101, which can be approximately 1.5 inches in length, are placed on the bottom of the right and left sides of the buttocks portion of the pants 5.

The at least one elastic band 100, or bands 101, would also support the diaper and prevent a diaper from putting too much weight on the straps 20, 40 connecting the pants 5 to the shirt 2 and causing the infant discomfort from the shirt 2 exerting pressure on the infant's body. Furthermore, with the at least one elastic band 100, or bands 101, securing the diaper closer to the infant's body, there will be less likelihood of leakage from a diaper, especially from a diaper that is full.

Figure 21:
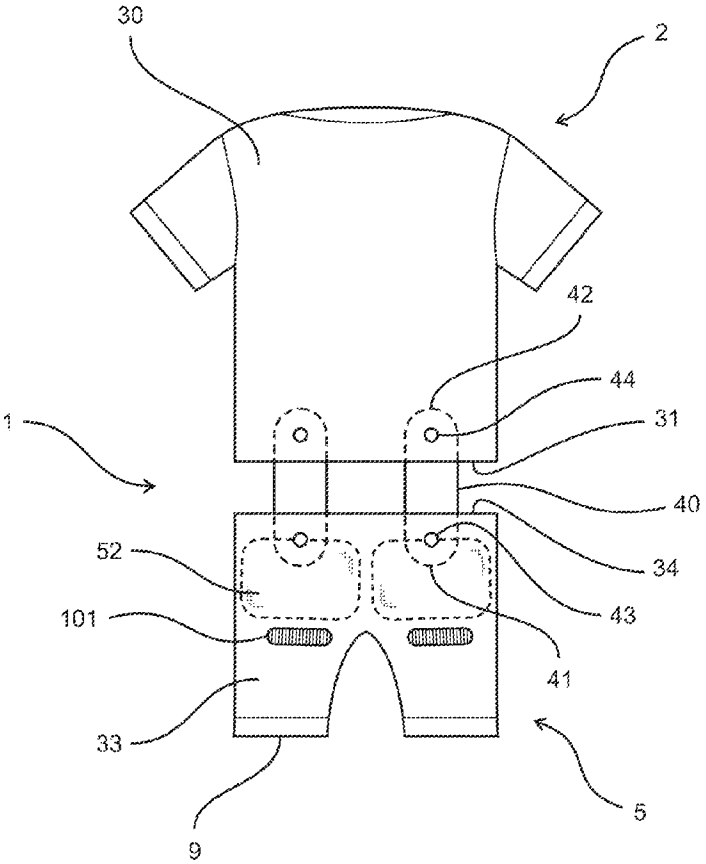
FIG. 21 and additional embodiment as shown in FIG. 19 depicting the invention with cushioning on the back, interior side of the pants and additional elastic straps on the right and left sides of the bottom of the buttocks portion of the pants.

The elastic bands 101 may also be used are used in conjunction with padding or cushioning 52 located on the buttocks of the pants 5, then the diaper will also be better secured to the infants body through the extra cushioning and the force from the at least one elastic band 100, or bands 101. FIG. 21 shows another embodiment of the invention where the cushioning 52 maybe found on the interior side 12 of the pants 5, as opposed to the exterior 13.

Figure 7:
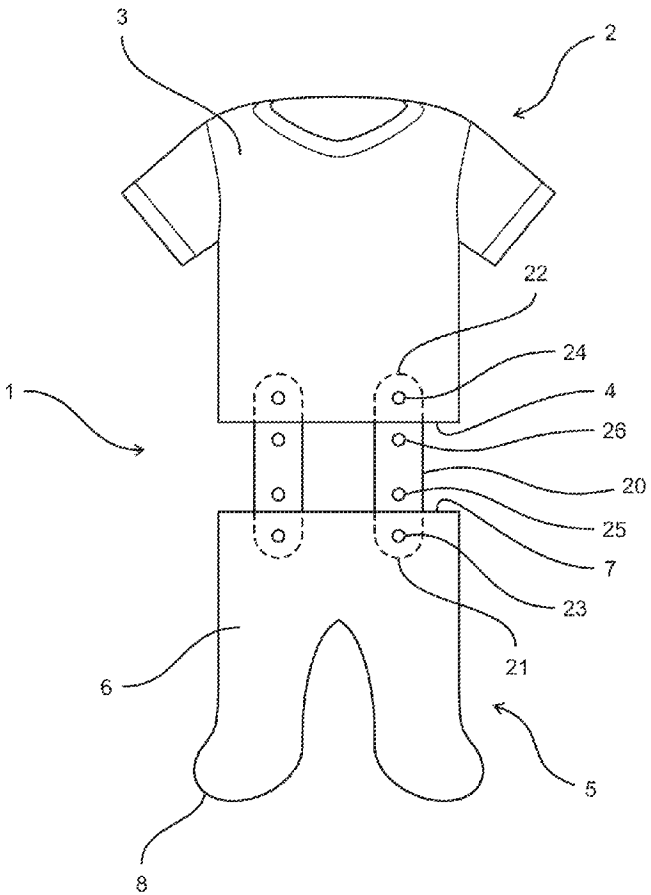
FIG. 7 is front view of an embodiment of the system in accordance with the present invention with straps that can be adjustable in tautness.

FIG. 7 illustrates another embodiment of the straps 20, which are secured to the shirt 2 and pants 5 by means of a plurality of fasteners 23-26. Near the first end 21 of the strap 20 are at least two fasteners 23 and 25, where at least one said fastener 23 or 25 may be secured to the interior 12 of the pants 5. Near the second end 22 of the strap 20 are at least two fasteners 24 and 26, where at least one said fastener 24 or 26 may be secured to the interior 10 of the shirt 2. One who practices the invention may also secure the strap 20 as described above to the exterior 13 of the pants 5, the exterior 11 of the shirt 2, or any combination thereof.

When the straps 20 have additional fasteners 23-26, the strap 20 is adjustable for tautness to promote a better fit for a growing infant. The fasteners 23-26 may be comprised of buttons, rivets, any equivalent means or combinations that may be practiced. Thus, infants are able to wear clothing 1 with less risk of suffocation, better temperature regulation, and offer parents greater ease in changing their infants.

Figure 8:
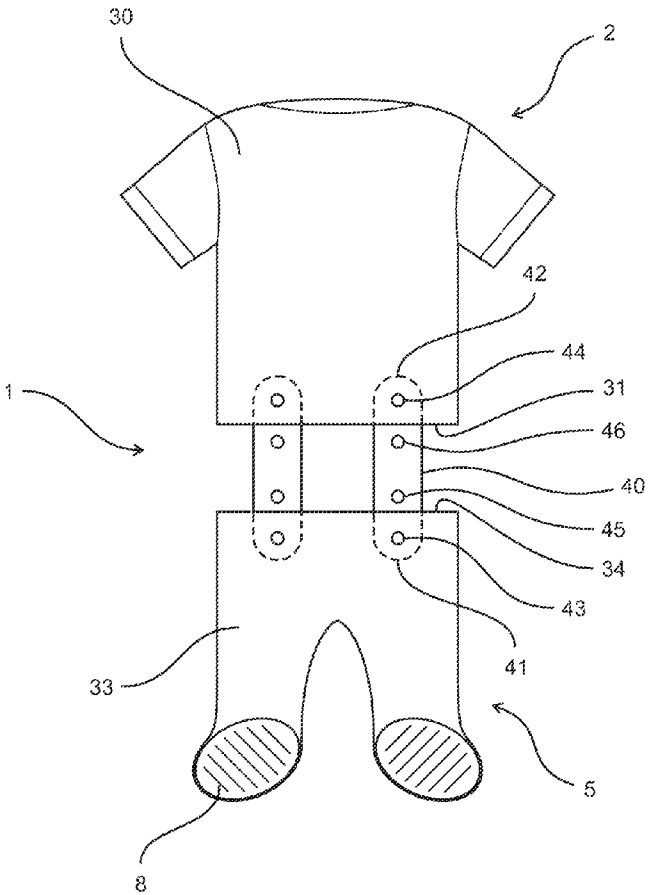
FIG. 8 is the rear view of an embodiment shown in FIG. 7.

FIG. 8 illustrates the rear view of a system of FIG. 7, which also has a plurality of fasteners 43-46 on strap 40.

I claim:

1. Diaper supporting clothing for a baby comprising:

a pair of pants having a front side, a back side, an exterior side, an interior side, and a top edge; wherein said back side of the pants have at least two elastic bands on said back side of the pants, wherein said first elastic band is positioned at an angle that is in line with the end of the infant wearer's diaper on said back, right, side of the pants and wherein said second elastic band is positioned at an angle that is in line with the end of the infant wearer's diaper on said back, left side of the pants;

a shirt having a front side, a back side, an exterior side, an interior side and a bottom edge;

at least two straps, each having a first end and a second end, wherein said first end of each strap is secured to said pair of pants in proximity to said top edge of the pants in spaced apart relationship to each other; wherein said second end of each strap is secured to said shirt in proximity to said bottom edge of the shirt; and whereby said shirt is resistant to riding up to smother said baby's face.

2. The clothing of claim 1 wherein said first end of each strap is secured to said back side of said pair of pants in proximity to said top edge of said pair of pants in spaced apart relationship to said at least two straps;

wherein said second end of each strap is secured to said back side of said shirt in proximity to said bottom edge of said shirt.

3. The clothing of claim 1 wherein said first end of each said strap is secured to said front side of said pair of pants in proximity to said top edge of said pair of pants in spaced apart relationship to said at least two straps;

wherein said second end of each strap is secured to said front side of said shirt in proximity to said bottom edge of said shirt.

4. The clothing of claim 1 wherein said first end of each said strap is secured to said exterior side of said pair of pants in proximity to said top edge of said pair of pants in spaced apart relationship to said at least two straps;

wherein said second end of each strap is secured to said exterior side of said shirt in proximity to said bottom edge of said shirt.

5. The clothing of claim 1 wherein said first end of each said strap is secured to said interior side of said pair of pants in proximity to said top edge of said pair of pants in spaced apart relationship to said at least two straps;

wherein said second end of each strap is secured to said interior side of said shirt in proximity to said bottom edge of said shirt.

6. The clothing of claim 1 wherein each strap secured to the pants and the shirt are adjustable in tautness.

7. The clothing of claim 6 wherein each of at least two straps has a plurality of fasteners.

8. The clothing of claim 1 further comprising a pair of foot coverings that is continuous from the pants.

9. The clothing of claim 8 wherein the foot coverings are made from a breathable material that readily exchanges air and moisture from the interior side of the foot covering to the exterior side of the foot covering.

10. The clothing of claim 1 wherein the pants have cushioning on the front side.

11. The clothing of claim 1 wherein the pants have cushioning on the back side.

12. The clothing of claim 1 wherein the back side of the pants have at least two elastic bands that are at least 1.5 inches in length, wherein said first elastic band is positioned on said right, back side of the pants and said second elastic band is positioned on said left, back side of the pants.

13. The clothing of claim 1 wherein said pair of pants have cushioning on the back side, and cushioning on the front side; a pair of foot coverings that are continuous from the pant legs made from a breathable material that readily exchanges air and moisture from the interior side of the pants to the exterior side of the pants; wherein the back side of the pants have at least two elastic bands that are at least 1.5 inches in length, wherein said first elastic band is positioned at an angle that is in line with the end of the infant wearer's diaper on said back, right, side of the pants and wherein said second elastic band is positioned at an angle that is in line with the end of the infant wearer's diaper on said back, left side of the pants;

wherein said at least two straps, comprised of an soft fabric material and adjustable in tautness through a plurality of fasteners, each having a first end and a second end, wherein said first end of each strap is secured to said back side and said interior side of said pair of pants in proximity to said top edge of said pair of pants in spaced apart relationship to said at least two straps;

wherein said second end of each strap is secured to said back side and said interior side of said shirt in proximity to said bottom edge of said shirt, and whereby said shirt is resistant to riding up to smother said baby's face.

14. Diaper supporting clothing for a baby comprising:

a pair of pants having a front side, a back side, an exterior side, an interior side, and a top edge; wherein the pants have at least one elastic band on said back side of the pants, wherein there are at least two elastic bands on said back side of the pants wherein said first elastic band is positioned at an angle that is in line with the end of the infant wearer's diaper on said back, right, side of the pants and wherein said second elastic band is positioned at an angle that is in line with the end of the infant wearer's diaper on said back, left side of the pants.

15. A method of using pants to hold up a diaper, the method comprising the steps of:

providing a pair of pants having a front side, a back side, an exterior side, an interior side, and a top edge; wherein said back side of the pants also have at least one elastic band;

providing a shirt having a front side, a back side, an exterior side, an interior side and a bottom edge;

securing at least two straps, each having a first end and a second end, wherein said first end of each strap is secured to said pair of pants in proximity to said top edge of the pants in spaced apart relationship to each other; wherein said second end of each strap is secured to said shirt in proximity to said bottom edge of said shirt; and whereby said shirt is resistant to riding up to smother said baby's face;

positioning said at least one elastic band on said back of the pants so that the said at least one elastic band is in line with the end of the infant wearer's diaper to secure the diaper closer to the infants body to prevent the diaper from dragging said pants downward.

16. The method of claim 15 further comprising the step of securing said first end of each said strap to said back side of said pair of pants in proximity to said top edge of said pair of pants in spaced apart relationship to said at least two straps;

Securing said second end of each strap to said back side of said shirt in proximity to said bottom edge of said shirt.

17. The method of claim 15 further comprising the step of securing said front side of said pair of pants in proximity to said top edge of said pair of pants in spaced apart relationship to said at least two straps;

securing said second end of each strap to said front side of said shirt in proximity to said bottom edge of said shirt.

18. The method of claim 15 further comprising the step of securing said first end of each said strap to said exterior side of said pair of pants in proximity to said top edge of said pair of pants in spaced apart relationship to said at least two straps;

securing said second end of each strap to said exterior side of said shirt in proximity to said bottom edge of said shirt.

19. The method of claim 15 further comprising the step of securing said first end of each said strap to said interior side of said pair of pants in proximity to said top edge of said pair of pants in spaced apart relationship to said at least two straps;

securing said second end of each strap to said interior side of said shirt in proximity to said bottom edge of said shirt.

* * * * *